US007804972B2

(12) United States Patent
Melanson

(10) Patent No.: US 7,804,972 B2
(45) Date of Patent: Sep. 28, 2010

(54) METHOD AND APPARATUS FOR CALIBRATING A SOUND BEAM-FORMING SYSTEM

(75) Inventor: John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 817 days.

(21) Appl. No.: 11/425,969

(22) Filed: Jun. 22, 2006

(65) Prior Publication Data

US 2007/0263889 A1 Nov. 15, 2007

Related U.S. Application Data

(63) Continuation-in-part of application No. 11/383,125, filed on May 12, 2006, now Pat. No. 7,545,946.

(51) Int. Cl.
*H04R 5/02* (2006.01)

(52) U.S. Cl. ..... 381/303; 381/306; 381/307; 381/300

(58) Field of Classification Search ..... 381/58, 381/59, 77, 300, 303, 2, 20, 21, 24, 304, 381/305, 61, 96, 97, 98, 56
See application file for complete search history.

(56) References Cited

U.S. PATENT DOCUMENTS 4,039,755 A 8/1977 Berkovitz
5,005,201 A 4/1991 Rumriech et al.
5,301,237 A 4/1994 Fosgate
5,598,480 A 1/1997 Kim
5,680,464 A 10/1997 Iwamatsu
5,809,150 A 9/1998 Eberbach
5,870,484 A * 2/1999 Greenberger ..... 381/300
6,057,659 A 5/2000 Akiyama et al.
6,373,955 B1 4/2002 Hooley
6,498,852 B2 12/2002 Grimani
6,665,409 B1 12/2003 Rao (Continued)

OTHER PUBLICATIONS

Murray, John, "Understanding Line Array Systems", Live Sound International, prosoundweb.com, 2006.

(Continued)

*Primary Examiner*—Vivian Chin
*Assistant Examiner*—George Monikang
(74) *Attorney, Agent, or Firm*—Andrew M. Harris; Mitch Harris, Atty at Law, LLC

(57) ABSTRACT

A method and apparatus system for calibrating a sound beam-forming system provides calibration of low cost alternatives to present array beam-forming systems. A test signal is supplied to multiple speaker drivers and is detected from a microphone signal supplied from a microphone positioned at a listening position. A signal relationship between surround channel information supplied to the multiple speaker drivers is adjusted in conformity with the detected signal so that the surround channel information is substantially attenuated along a direct path toward the listening position. The result is that the surround channel information is propagated in a directivity pattern having at least one primary lobe directed away from the listening position so that the surround channel information is diffused by reflection before reaching the listening position. The signal relationship may be controlled by multiple digital filters that maximize late vs. early response of the surround channel information.

20 Claims, 10 Drawing Sheets

U.S. PATENT DOCUMENTS

| | | | | |
|---|---|---|---|---|
| 6,778,672 | B2 * | 8/2004 | Breed et al. | 381/86 |
| 6,937,737 | B2 | 8/2005 | Polk | |
| 7,099,482 | B1 * | 8/2006 | Jot et al. | 381/61 |
| 7,123,731 | B2 * | 10/2006 | Cohen et al. | 381/303 |
| 7,382,885 | B1 | 6/2008 | Kim et al. | |
| 2001/0038702 | A1 | 11/2001 | Lavoie et al. | |
| 2004/0013271 | A1 | 1/2004 | Moorthy | |
| 2004/0151325 | A1 | 8/2004 | Hooley et al. | |
| 2004/0196405 | A1 | 10/2004 | Spinelli | |
| 2005/0041530 | A1 | 2/2005 | Goudie et al. | |
| 2005/0175194 | A1 | 8/2005 | Anderson | |
| 2005/0177256 | A1 | 8/2005 | Shintani et al. | |
| 2005/0226425 | A1 | 10/2005 | Polk | |
| 2006/0049889 | A1 | 3/2006 | Hooley | |
| 2007/0183608 | A1 | 8/2007 | Willems | |

OTHER PUBLICATIONS

Polk, Matthew S. "SDA Surround Technology White Paper", Polk Audio.

Product Brochure, Yamaha YSP-1 Digital Sound Projector.

Product Brochure, Yamaha YSP-1000 Digital Sound Projector.

* cited by examiner

METHOD AND APPARATUS FOR CALIBRATING A SOUND BEAM-FORMING SYSTEM

CROSS-REFERENCE TO RELATED PATENT APPLICATIONS

The present application is a Continuation-in-Part of U.S. patent application Ser. No. 11/383,125, entitled "METHOD AND SYSTEM FOR SURROUND SOUND BEAM-FORMING USING THE OVERLAPPING PORTION OF DRIVER FREQUENCY RANGES", filed on May 12, 2006 now U.S. Pat. No. 7,545,946 by the same Inventor and assigned to the same Assignee. The specification of the above-referenced U.S. patent application and its parent U.S. patent application Ser. No. 11/380,840, entitled "METHOD AND SYSTEM FOR SOUND BEAM-FORMING USING INTERNAL DEVICE SPEAKERS IN CONJUNCTION WITH EXTERNAL SPEAKERS", filed on Apr. 28, 2006, are incorporated herein by reference. The present application is also related to U.S. patent application Ser. No. 11/421,381, entitled "METHOD AND SYSTEM FOR SURROUND SOUND BEAM-FORMING USING VERTICALLY DISPLACED DRIVERS" and Ser. No. 11/425,976, entitled "RECONFIGURABLE AUDIO-VIDEO SURROUND SOUND RECEIVER (AVR) AND METHOD", by the same inventor and assigned to the same Assignee, which are also incorporated herein by reference.

BACKGROUND OF THE INVENTION

1. Field of the Invention

The present invention relates generally to home entertainment devices, and more specifically, to techniques for calibrating an audio or audio/video (A/V) device including a surround sound beam-forming system.

2. Background of the Invention

Audio systems in home entertainment systems have evolved along with theatre audio systems to include multi-speaker surround sound capabilities. Only recently have discrete surround signals been available from sources in home entertainment systems and further only recently have encoded sources reached a sufficient level of home use for consumers to justify installation of the requisite equipment. With the development of Digital Versatile Disc (DVD) technology that provides surround audio source information for movies or surround-encoded music, and sophisticated computer games that provide surround audio, surround speaker installation in home environments has become more desirable and frequent. With the recent availability of digital television (DTV) signals, which can include surround audio signals as part of their audio-visual (A/V) information, increasing sales of televisions and/or DTV sets including surround channel outputs are expected. The surround signals may be encoded in a pair of stereo signals, such as early DBX or as in more recent Dolby or THX surround encoding, or may constitute a fully separate audio channel for each speaker, often referred to as discrete encoding.

In most consumer surround audio systems, an amplifier unit, which may be included in an AV receiver or in a television, provides signals to multiple sets of speakers, commonly in what is referred to as a 5.1, 6.1 or 7.1 arrangement. The 5.1 arrangement includes right, center and left main speakers located in the front of the room, and a right-left pair of surround speakers located in the rear of the room for providing an aural environment in which sounds can be psychoacoustically located such that they emanate from any horizontal direction. The "0.1" suffix indicates that an additional subwoofer is provided for providing low frequency sounds that are typically not sensed as emanating from a particular direction. The 6.1 configuration adds a center channel speaker in the surround speaker set and in a 7.1 configuration, an additional pair of speakers is included over the 5.1 configuration and located even farther back in the room from the surround channel speakers.

However, proper installation of surround channel speakers can be costly and undesirable in many home environments. Wiring must be added and locations with unobstructed paths to the listening area must be available. Since the surround channel audio sources are generated for a particular location of the speakers, they cannot be simply placed at any location in the room and still function properly. It is desirable to position the surround speakers in such a way that the surround sound is diffuse, often limiting possible locations for speaker placement. The term "diffuse" indicates that the sound does not appear to emanate from a single direction, which is generally provided via reflections from or more surfaces that cause the sound to be reflected toward the user from multiple angles.

There are essentially two types of surround sound implementations for handling the additional surround channel information: simulated surround and actual surround. In actual surround sound implementations, surround channel signals are provided to speakers placed behind the listener. In simulated surround implementations, the surround channel signal is provided to speakers placed in front of the listener.

Simulated surround sound implementations typically use filtering and/or delays to alter mono or stereo audio signals to provide outputs for additional front speakers to generate the surround field. U.S. Pat. No. 6,937,737 describes a simulated surround sound system that provides the right and left surround channel information to each side (right and left) of an additional stereo speaker pair as well as to each side of the main stereo speaker pair. The frequency response of the system is controlled to cause the apparent position of the surround channel information to appear wider than the speaker position. However, such systems do not provide surround sound performance approaching that of actual surround sound implementations.

Therefore, beam-forming systems have been developed that provide surround sound fields from encoded or discrete sources that are not only widening systems, but form beams that can direct the sound toward walls and away from the listener, thus providing the surround channel information as reflections. Such systems typically use a large horizontally distributed array of speakers in order to form separate beams for the surround channel sources that direct the surround channel sound away from the listener toward the walls so that the surround channel sounds arrive later and from a different angle. However, such arrays are costly, as separate drivers must be provided for each element in the array. Further, tuning of such an array system can be complicated by the lack of unobstructed paths to the reflection zones at the walls of the room. U.S. published Patent Application 20040151325A1 describes such a large horizontal array beam-forming system and U.S. published Patent Application 20050041530A1 describes a two-dimensional array system that provides a beam focused in both horizontal and vertical planes.

The above-incorporated U.S. patent applications each discloses systems for beam-forming that do not require large horizontal and/or vertical arrays. As a result, a low-cost system is provided that can simulate a surround field by diffusing surround channel information, some of which may be pre-tuned for installation in a typical listening room. However, depending on the particular room installation, a pre-tuned configuration may or may not be suitable or may not provide the best result that can be obtained with the techniques disclosed in the above-incorporated U.S. patent applications. Further, while other systems, such as large arrays are typically tuned by beam-steering according to known element displacements in fixed large arrays, performance in an actual room installation may not reach ideal performance levels It would therefore be desirable to provide a method and apparatus for calibrating sound beam-forming systems in general, including those beam-forming systems disclosed in the above-incorporated U.S. patent applications.

SUMMARY OF THE INVENTION

The above stated objectives of calibrating a sound beam-forming system is satisfied in a method and calibration apparatus that may be incorporated within a device supplying sound beam-forming capability.

The method provides a test signal to multiple speaker drivers through an electronic beam-forming network surround channel input. Then using a microphone, the sound propagated from the multiple speaker drivers is detected at a listening position.

A signal relationship between the surround channel input and at least one of the multiple speaker drivers is adjusted in conformity with sound detected at the listening position in order to control propagation of the surround channel information in a direction toward the listening position so that the direct sound is substantially attenuated. The surround channel information is thereby propagated by the multiple speaker drivers according to a directivity pattern having at least one lobe directed away from the listening position, so that the surround channel information is substantially only heard as reflections from the walls or ceiling of the listening room, rather than propagating directly toward the listening position. The adjustment criteria may be to maximize the late vs. early response for the surround channel information at the listening position.

The signal relationship adjusted by the calibration method may be a frequency-dependent phase or phase/amplitude relationship provided by adjustable finite impulse response (FIR) filters, or may be another less complex adjustment, such as an amplitude adjustment of a canceling surround channel signal applied to a front directed speaker driver carrying primarily main channel information, but including a canceling surround channel signal for canceling sound directed toward the listening position from a surround channel speaker that is oriented in another direction.

The calibration apparatus includes a test signal source, a microphone, a microphone preamplifier circuit and a detector for detecting the signal received by the microphone. The detector may be a correlator and may include multiple correlators for correlating multiple information sources encoded within the test pattern, such as surround and main channel information for multiple pairs of speaker drivers. Alternatively, a single correlator may be use in successive measurements to determine surround channel response for each set of drivers at the listening position and optionally the main channel response, as well.

In other embodiments of the invention, generally provided as selectable operating modes in conjunction with the above-described surround beam-forming, calibration of beam-forming types other than surround beam-forming may be employed. In one such "night mode" calibration technique and operating mode, a beam-forming system is calibrated to form a beam as narrow as possible at a specific listening location, so that program information is not as audible in other directions away from the specific listening position. In yet another operating mode, the beam-forming system is calibrated to provide separate program information to two different listening positions to maximize audio separation at one listening position from the program information provided to another listening position.

The above-described objectives, features, and further advantages of the invention are described in more detail below, in conjunction with the accompanying drawings, in which like reference numerals indicate like elements.

BRIEF DESCRIPTION OF THE DRAWINGS

Details of the invention and the uses thereof will be understood by a person of skill in the art when reading the following description in conjunction with the accompanying drawings. Further objectives and advantages presented by the invention will be apparent in light of the following description and drawings, wherein like reference numerals indicate like components, and.

DESCRIPTION OF ILLUSTRATIVE EMBODIMENT

The present invention encompasses systems and methods for calibrating audio systems that include beam-forming capabilities. The system may be a device such as a video device having speakers included for the rendering of audio content, such as a DTV or computer monitor, may be an audio-only device, such as a stereo system having internal speakers, or beam-forming capabilities may be incorporated within the speaker cabinets attached to an ordinary audio or video device. In a surround simulation mode, the surround channel signal(s) are provided via beam-forming that produces reflections via one or more beams directed away from the listener. The beam(s) are formed by a phase-aligned combination of an internal and an external speaker and calibrated by a method according to an embodiment of the present invention using a test signal and a microphone. Special beam-forming modes provide an isolated listening location for night-time viewing ("Night Mode") or for simultaneous viewing of split-screen or picture-in-picture (PIP) program selection in two or more listening locations, and are calibrated by methods in accordance with other embodiments of the invention. In each of the calibrations made according to the present invention, the goal is to achieve a substantial attenuation of sound (e.g., 6 dB or more) due to a particular input at one or more particular positions by adjusting a directivity pattern produced by multiple speaker drivers.

The above-incorporated U.S. patent applications disclose various systems and speaker configurations for providing surround sound beam-forming without requiring a horizontal speaker array having a large number of elements. The present invention includes methodologies and for calibrating the systems disclosed therein, as well as other simulated surround sound systems. The present invention also includes methodologies for calibrating the night-mode and split-screen/picture-in-picture (PIP) modes of the above-incorporated U.S. related patent application "METHOD AND SYSTEM FOR SOUND BEAM-FORMING USING INTERNAL DEVICE SPEAKERS IN CONJUNCTION WITH EXTERNAL SPEAKERS" as well as other systems using speaker drivers located in separate speaker cabinets for beam-forming in such modes.

Figure 1B:
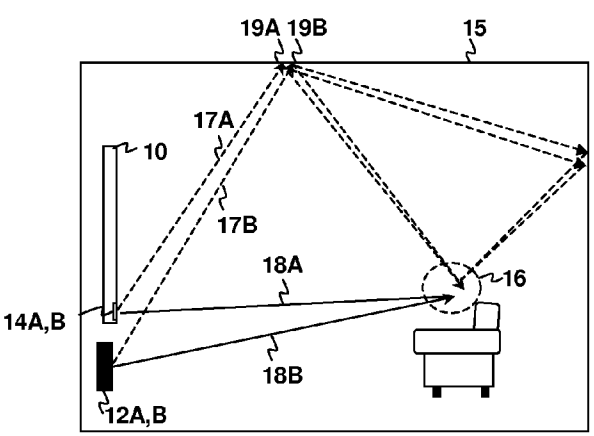
FIGS. 1A-1D are views of a room incorporating a DTV surround-sound system that includes calibration circuits for calibration of the system according to methods of the present invention.
Figure 1D:
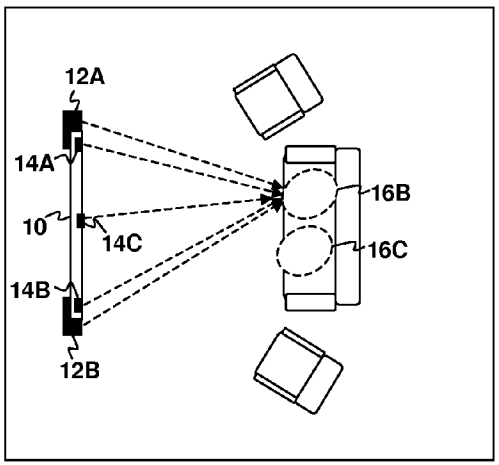
Figure 1A:
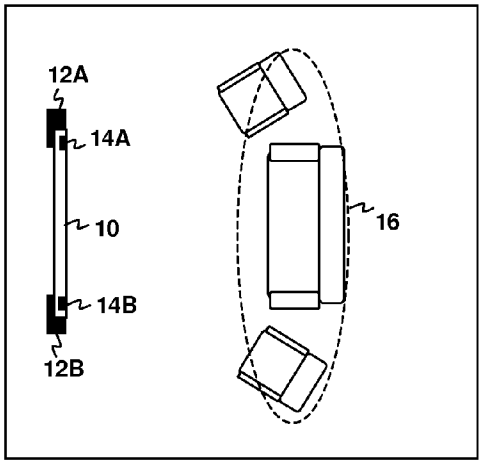

Referring now to the Figures, and in particular to FIGS. 1A and 1B, operation of a system including calibration circuits and/or program instructions that perform calibration methods in accordance with embodiments of the present invention is illustrated. The illustrated system is a DTV 10 that includes an internal set of stereo speakers 14A-B and a set of external speakers 12A-B having inputs coupled to DTV 10 for operating external speakers 12A-B in phase-alignment with internal speakers 14A-B. The term "phase-alignment" is understood to define a particular phase relationship between the speakers and not necessarily a zero-time aligned relationship with respect to each channel and speaker. In fact, it is the difference between the time-alignment for surround channels versus main channels that provides the directionality used in the present invention to present diffuse surround channel information and direct main channel information from speakers located substantially near a single wall of a room.

In contrast to typical horizontal surround beam-forming arrangements, the DTV of the present invention uses the vertical offset of speakers within speaker pairs 12A, 14A and 12B, 14B to project a beam 17A, 17B to reflection points 19A, 19B, which follow a path to a listening area 16 as shown that is longer than the distance traveled along a direct path 18A, 18B to the listener via reflection from the ceiling and also the rear wall. While lines are used to illustrate beam directions in the Figures, in actuality the lines represent only the direction of maximum intensity and in actuality the directivity pattern of interference between speakers 12A, 14A and similarly 12B, 14B will dictate the spread of acoustic energy along ceiling 15 that provides a diffuse reflected beam that is provided with surround-channel information. The right and left surround channel beams can be directed upward and toward their respective directions, reflecting at the wall and ceiling, in either order, to provide some directional relationship from right to left in the surround channel information.

The present invention, in one embodiment, calibrates the system so that the main channel (front speaker) information is maximized according to the vector sum of direct paths 18A, 18B such that the main speaker information is provided in-phase at listening position 16, while the surround channel (rear speaker) information is substantially attenuated by the vector sum of direct paths 18A, 18B, so that a listener at listening position 16 will hear the surround channel information only as reflected energy from ceiling 15 and room walls. Since each pair of speakers 12A, 14A and 12B, 14B provides a two-lobed pattern, another maximum intensity beam is directed toward the floor of the room. However, the floor in a home environment is typically carpeted, which attenuates the higher frequencies involved in the surround channel beam. Further, the system will generally be calibrated to suppress the reflection from the floor, which is also more subject to obstruction, even if the floor is sound-absorbent. Also, in the configuration shown, the floor path to the listener would be shorter, and thus provide less apparent distance. In general, it is desirable to spread external speakers 12A-B slightly wider than the internal speaker spacing, which is generally limited to around 50 inches. The wider spread provides not only generally better main channel stereo imaging, but the horizontal displacement aids in flexibility with respect to beam-forming calibration, particularly in PIP and Night Modes. Also, if DTV 10 is mounted on a wall, it is generally desirable to mount external speakers 12A-B slightly below DTV 10 or in general, at approximately mid-height with respect to the total height of the wall.

The surround beam-forming calibrated by the present invention generally uses a limited band of frequencies that is above the low-frequency range where beam-forming is not necessary due to the non-directive perception of low frequency acoustic energy and also not practical due to the spacing required in the beam-forming array. Energy below approximately 250 Hz is generally provided only in the direct channel, which is either a substantially in-phase signal provided to internal speakers 14A-B and external speakers 12A-B, or the low-frequency information may be provided only to external speakers 12A-B. The low-frequency cut-off frequency can be set in conformity with a typical speaker spacing such that no beam is formed for the common (in-phase) low frequency information. However, the practical low-frequency cut-off can be "learned" during the calibration process described below and the cut-off frequency adjusted in conformity with the calibration measurement results. Additionally, the calibration method can determine whether it is practical to use the internal speakers 14A-B for low frequency operation. If poor low-frequency response is detected with respect to internal speakers 14A-B, they can be selectively disabled.

In general, there is a trade-off between the lowest and highest practical beam-forming frequencies that is determined by the speaker spacing. The high-frequency cutoff for the beam-forming is also set in conformity with the speaker spacing such that combing effects are minimized. In general, practical high-end cutoff frequency for external speakers used in conjunction with internal speakers will be around 2500 Hz, due to the spacing between the internal and external speakers. However, the practical high-frequency cut-off can be "learned" during the calibration process described below and the cut-off frequency adjusted in conformity with the calibration measurement results. Since external speakers 12A-B are generally supplied by or may be replaced by the system owner, external speakers 12A-B can be provided with whatever level of low-frequency performance and amplification the consumer desires. The speakers employed in DTV devices, which must fit the package dimensions and cost point for the DTV components, will generally have poorer low-frequency performance than even a low-cost set of external bookshelf speakers. Additionally, less amplifier power is required for the higher-frequency audio bands, and therefore the amplifiers provided in DTV 10 can be much smaller and dissipate less heat if only the higher-frequency components of the main and surround channel signals are provided to internal speakers 14A-14B.

The beam-forming channel is also generally band-limited to remove higher frequencies, for example, those above approximately 2500 Hz, for which the spacing between speaker pairs 12A, 14A and 12B, 14B usually extends to multiple wavelengths, and therefore would generate a "combing" effect that would be difficult to remove with calibration. For this purpose, the high-frequency information may be provided to internal speakers 14A-B and removed from the signals provided to external speakers 12A-B. Internal speakers 14A-B are generally provided with signals directly from amplifiers internal to DTV 10. The high-frequency information can be processed via delays or filtering to provide a simulated surround effect from a single speaker used as a tweeter. External speakers 12A-B will generally be powered speakers that receive either a corresponding line-level analog output signal from DTV 10 or a digital signal such as an optical or coaxial SONY/PHILIPS Digital Interface (S/P-DIF) connection. However, additional amplifiers may be included within DTV 10 that can provide power signals to external "non-powered" speakers.

Figure 1C:
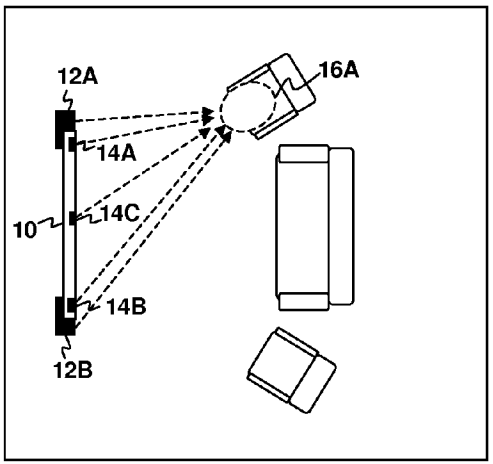

Additional non-surround beam-forming modes are also calibrated in the system of FIGS. 1A and 1B. In a "Night Mode", as illustrated in FIG. 1C, the system can be calibrated to neutralize sound in all zones apart from a particular limited listening area 16A and in "Picture-in-Picture (PIP) Mode", for use with split screen viewing or PIP screen presentation of video, two listening areas 16B and 16C can be provided as illustrated by FIG. 1D, where the goal is not to neutralize sound outside the listening areas 16B and 16C, but to maximize isolation between the two zones, which is generally accomplished by using the right and left stereo channels for the separate audio information, but calibrating the system to neutralize sound for the non-corresponding channel within each of listening areas 16B and 16C. Horizontal beam formation is required for both modes described above, and in particular, the PIP mode can be accomplished somewhat using the horizontal displacement between the right and left pairs of speakers 12A, 14A and 12B, 14B and directing nulls with respect to the undesired program channel at each listening position.

However, to achieve a pattern that has a beam at only one position, in particular for Night Mode, more horizontal distribution of control is required. The horizontal distribution can be accomplished by some displacement between internal speakers 14A-14B and the corresponding external speakers 12A-12B, as well as the displacement between the right and left pairs. If a center channel speaker 14C is provided either in DTV 10 or external to DTV 10, center channel speaker 14C will aid in the horizontal pattern control employed in Night Mode and PIP mode. Further, additional horizontally displaced speaker pairs may be added to the system and provided with their own adjustable signal paths.

Systems without internal speakers forming part of a beam-forming system, such as those disclosed in the above-incorporated U.S. patent application "METHOD AND SYSTEM FOR SURROUND SOUND BEAM-FORMING USING VERTICALLY DISPLACED DRIVERS", and in particular those using the overlapping out-of-band portions of driver pairs as disclosed in the parent U.S. patent application "METHOD AND SYSTEM FOR SURROUND SOUND BEAM-FORMING USING THE OVERLAPPING PORTION OF DRIVER FREQUENCY RANGES", can also be calibrated by methods according to embodiments of the present invention. When the driver frequency ranges differ, or when drivers are used outside of their specified frequency bands, the above frequency limitations on the beam-forming range can be further refined to establish proper operating frequency ranges for the drivers. Additionally, when driver pairs of differing frequency ranges are employed in the beam-forming process, the speakers can be oriented with the drivers in a horizontally displaced configuration and calibrated to provide further spatial discrimination for night-mode and PIP beam-forming modes.

Figure 2:
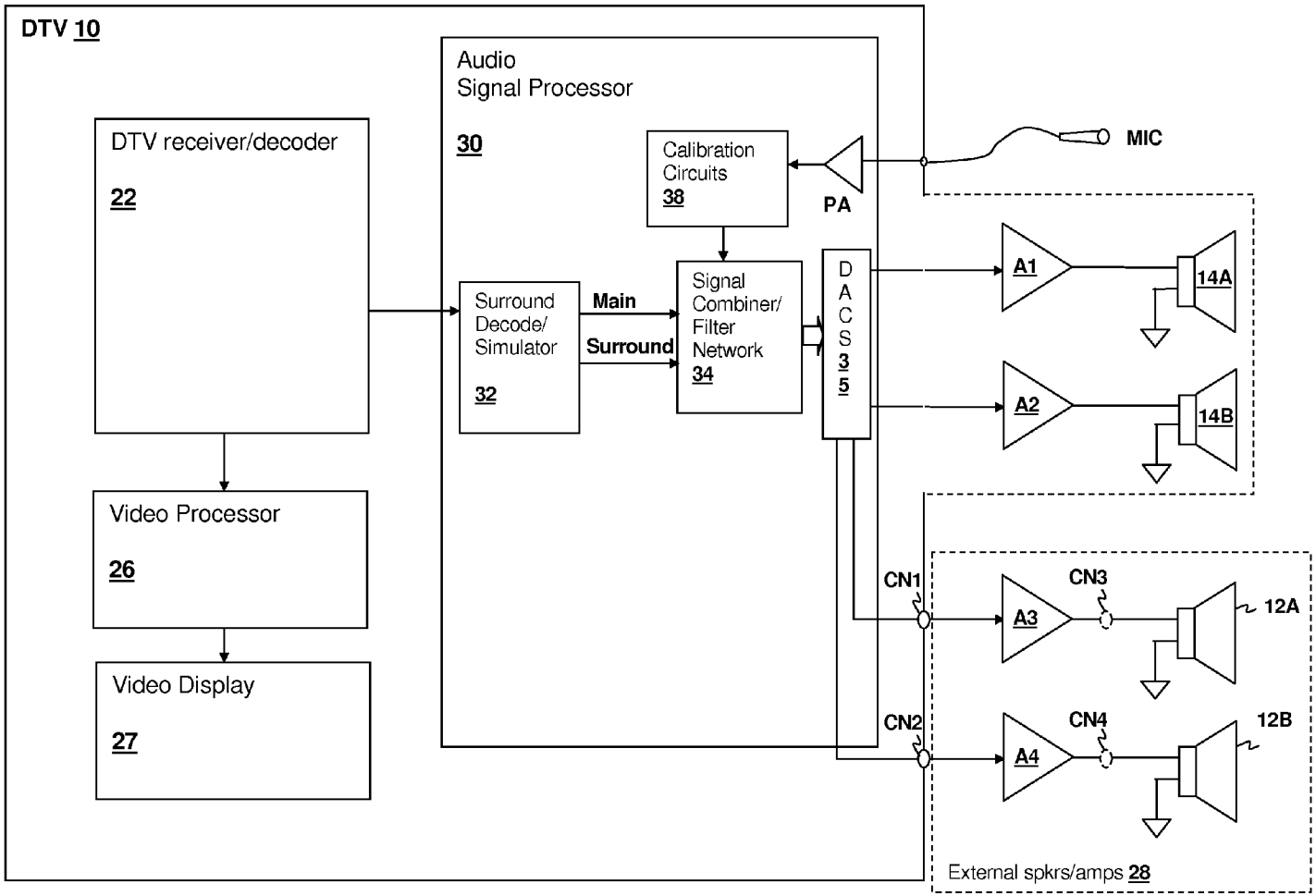
FIG. 2 is a block diagram of the DTV surround sound system of FIGS. 1A-1D.

Referring now to FIG. 2, a block diagram of circuits within the system of FIG. 1 is shown. DTV 10 includes a DTV receiver/decoder 22 that receives digital and/or analog television signals from a cable television (CATV), digital versatile disc (DVD) player, videocassette recorder (VCR), antenna or other form of signal connection (not shown) and provides video information to a video processor 26 that supplies graphical information to a video display 27. Video processor 26 supports such features as picture-in-picture (PIP) and split-screen modes that are relevant to some of the surround audio beam-forming modes described in detail below. DTV receiver/decoder 22 also provides audio information to an audio signal processor 30 that includes a surround decode/simulator circuit 32, calibration circuits 38 that receive a signal from an external microphone MIC via a preamplifier PA, and a signal combiner/filter network 34. Calibration circuits 38 are controlled by control elements described in further detail below, by methods and algorithms according to embodiments of the present invention. Microphone MIC is ideally an omni-directional microphone, so that all responses with respect to a given speaker or combination of speakers is detected during calibration. The outputs of signal combiner/filter network 34 are provided to DACs 35 that generate analog output signals for internal speakers 14A-B via corresponding power amplifiers A1 and A2, and also to external connectors CN1 and CN2 that supply line-level signals to amplifiers A3 and A4, which in turn supply power signals to speakers 12A-12B. DACs 35 and amplifiers A1-A2 may be replaced with pulse-width modulator/filter circuits. Alternatively, connectors CN3 and CN4 may be provided if amplifiers A3 and A4 (or PWM output drives/filters) are incorporated within DTV 10.

Surround decode/simulator circuit 32, decodes any encoded main channel, surround channel and other surround-sound information in the audio stream(s) provided from DTV receiver/decoder and may optionally synthesize surround channel information if such surround-sound information is absent from the audio streams(s). Signal combiner/filter network 34 receives the main and surround channel information for each stereo side and generates the proper signals via digital-to-analog converters (DACs) 35 to amplifiers A1-4 to form the direct beam for the main channel information and the reflected beam for the surround channel information. Calibration circuits 38 tune filters within signal combiner/filter network 34 during a calibration set-up process in order to provide the best response at listening position 16 for the main channel information and to maximize the delay of the reflected energy for the surround channel information, when in surround mode. In the other operating modes, the calibration circuits 38 provide other pattern control tuning consistent with those modes as described in further detail below.

Figure 3B:
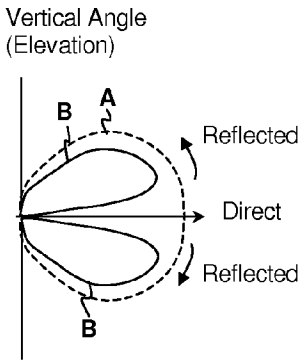
FIG. 3B is a graph showing sound pressure level directivity patterns produced by the speaker arrangement of FIG. 3A in surround mode.
Figure 3A:
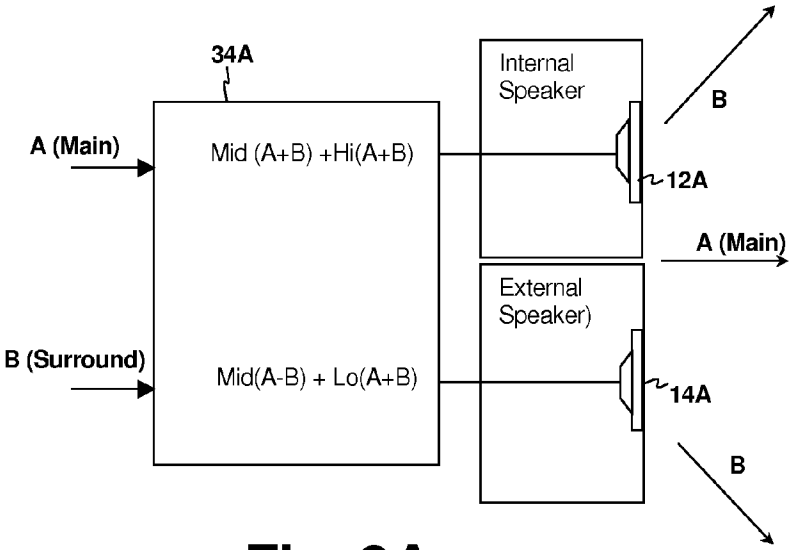
FIG. 3A is an illustration showing a speaker arrangement that can be employed in the system of FIGS. 1 and 2.

Referring now to FIG. 3A, an illustration showing a speaker arrangement that may be employed in the system of FIGS. 1 and 2 is depicted. In the depicted system, internal speaker 12A is used at higher frequencies and the beam-forming midrange frequencies and external speaker 14A is used at lower frequencies and the beam-forming midrange frequencies. Therefore, both speakers are active in the midrange beam-forming frequency range. With an internal/external speaker configuration, both speakers will typically have a full-range response, but a full-range response is not a requirement to practice the invention. A simplified combiner 34A is shown for illustrative purposes. Signal combiner 34A receives a main channel signal A and a surround channel signal B. The signal provided to internal speaker 12A is A+B for both the midrange (overlap range) and the high frequency range, and the signal provided to external speaker 14A is A−B for the midrange and A+B for the low-frequency range.

The result of the operation of combiner 34A is that the midrange of the surround channel signal B is provided out-of-phase (as between speakers 12A and 14A) along the direct path to a listener located on-axis between speakers 12A and 14A, thus producing a null with respect to the midrange surround channel information toward the listener. Thus, the listener will not hear the surround channel information as emanating from speakers 12A and 14A, but will rather hear the surround channel information as diffuse, coming from a range of reflection points primarily along the ceiling of the room. The main channel midrange information is provided in-phase (as between speakers 12A and 14A) along the direct path, so that the main channel information is heard as emanating from the speakers. In the low-frequency range and also for the high-frequency range, the main and surround channel information are combined and are only supplied to one speaker of each vertically-displaced speaker pair, so that no beam-forming is produced in those frequency ranges.

Referring now to FIG. 3B, a directivity pattern of the speaker arrangement of FIG. 3A is shown for the midrange beam-forming range. Signal A is shown as having a substantially cardioid shape, while signal B is produced in two lobes, one directed at the ceiling and one directed at the floor, due to the vertical displacement of speakers 12A and 14A.

Figure 3D:
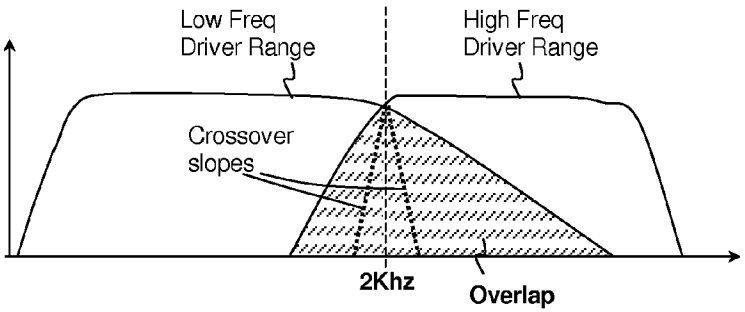
FIG. 3D is an illustration showing an alternative frequency response of speaker driver channels within the system of FIGS. 1 and 2.
Figure 3C:
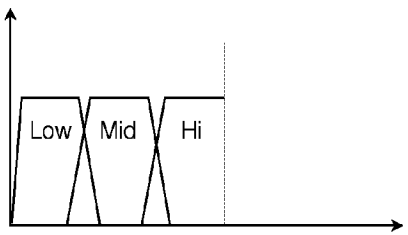
FIG. 3C is a graph illustrating a frequency response of speaker driver channels within the system of FIGS. 1 and 2.

FIG. 3C illustrates the three band filtering scheme of combiner 34A in which beam-forming is employed in the midrange frequency band Mid. In the Low frequency band, the sum of the main and surround channel information can be sent to both speakers, since the longer wavelengths will ensure that the drivers act in phase. Alternatively, the Low band might be provided only to external speakers selectively, in response to the results of a calibration or user setting, or as a fixed design feature under the assumption that the external speakers 12A-B will have superior low frequency response. In the High frequency band, generally only one of the full-range speakers will be used so that "combing" effects do not occur due to interference between the speakers.

FIG. 3D illustrates the frequency response of drivers 14A and 14B and the crossover filtering scheme of combiner 34A in an alternative system as disclosed in the above-incorporated parent U.S. Patent Application "METHOD AND SYSTEM FOR SURROUND SOUND BEAM-FORMING USING THE OVERLAPPING PORTION OF DRIVER FREQUENCY RANGES", in which driver pairs having differing frequency ranges are operated outside of their specified ranges to provide beam-forming action. Beam-forming is employed in the shaded overlap frequency band shown. The crossover slopes (dotted lines) show the main channel crossover frequency locations, which differ from the overlap frequency range boundaries.

Figure 4A:
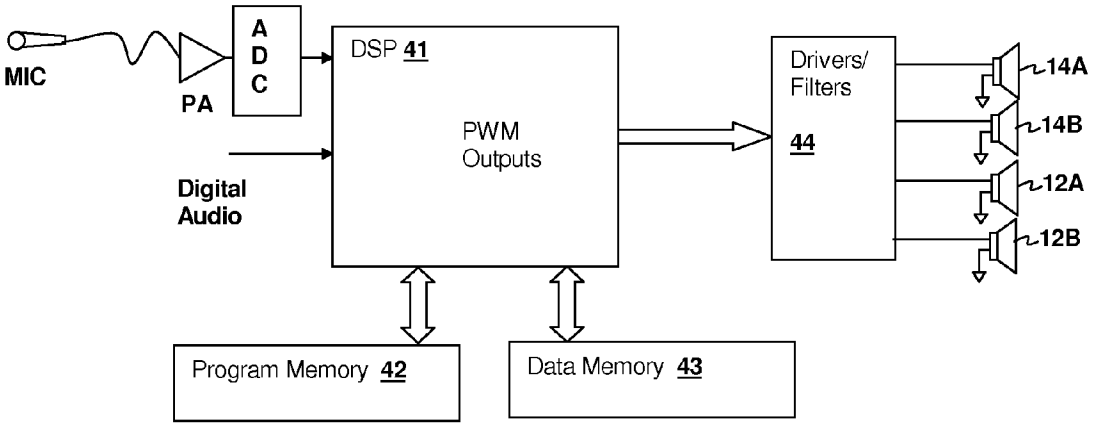
FIG. 4A is a block diagram of another system that includes program instructions for performing calibration methods in accordance with an embodiment of the present invention.

Referring now to FIG. 4A, a system in accordance with an embodiment of the present invention is shown. The depicted system employs a digital signal processor (DSP) 41 that performs the calibration of the present invention and the signal combining/filtering functions, as well as frequency-band splitting and any compression/protection algorithms used in the system. Microphone MIC is connected to preamplifier PA, which provides signals to analog-to-digital converter ADC, which provides a detected signal for calibration from a test signal generated by DSP 41. DSP 41 is coupled to a program memory 42 containing program instructions forming a computer program product in accordance with one or more embodiments of the present invention, and further coupled to a data memory 43 for storing data used by the computer program and results produced thereby. The outputs of DSP 41 are depicted as pulse-width modulator (PWM) outputs for each channel, with corresponding low-pass filters and driver transistors 44, generally half-bridge circuits with series LC filters connected to speakers 14A-14B and optionally (non-powered) speakers 12A-12B. The calibration, signal combining, filtering and compression operations performed by the algorithms of the computer program within program memory 42 will be described in further detail below in illustrations that apply to discrete circuits as well as the calibration algorithms executed by DSP 41.

In the "night mode" and split-screen or PIP operating modes described above, DSP 41 can also be used to detect the nature of the sounds provided by the audio channel(s) and operate the beam-forming algorithms accordingly. Detection of speech is performed by correlating the stereo signals provided for each channel, since most speech information is presented monophonically (i.e., equal and in-phase levels at each channel). The signals are also further analyzed to detect modulation patterns, e.g. envelope shapes that characteristically different for music and speech. The common information between the channels can be processed to detect speech modulation patterns, and the detected speech information can be increased in amplitude or extracted for presentation in the split-screen or PIP operating modes. DSP 41 then equalizes, compresses, and re-processes the audio information provided by each direct beam to improve intelligibility of speech in each direct beam, while the other direct beam might have speech or music. For example, since unintelligible speech will generally detract completely from television viewing, while musical background or other presentation is generally far less critical, speech can be favored over music as shown in Table I below, which can be applied to PIP or split-screen modes. The surround beams can be provided with the wide portion of the stereo program (i.e., the uncorrelated information between right and left in each stereo signal source), without detracting much from either program's audio.

TABLE I

| Channel 1 | Channel 2 | Processing |
|---|---|---|
| Speech | Speech | Boost high frequencies moderately, equalize levels between channels, attenuate frequencies where beam-forming is ineffective |
| Speech | Music | Slightly attenuate music, especially reducing 500-2000 Hz region |
| Music | Music | Apply multi-band level equalization |

Calibration of beams in PIP or split-screen modes involves placement of the calibration microphone at each location for individual calibration, the provision of two or more directional microphones for simultaneous calibration, or an assumption that the performance of the listening environment will be symmetrical across a line dividing the two listening areas. The response of the direct beam with respect to the two program channels can be optimized by minimizing the ratio of the other program information to the program associated with the beam being measured. "Night Mode" performance can be optimized to reduce the amount of low frequency information, while retaining speech intelligibility and beam forming capability that restricts the space in which sound can be heard. For that purpose, high-frequency energy may also be attenuated in the ranges where combing can cause significant sidelobes to emerge. Calibration can be performed by placement of the microphone in the listening position and tuning the response of the individual horizontal and vertical array elements to form a narrow beam at the listening position. Alternatively or in combination, other positions at angles significantly apart from the listening position direction may be measured and the direct sound present at those positions minimized.

Figure 4B:
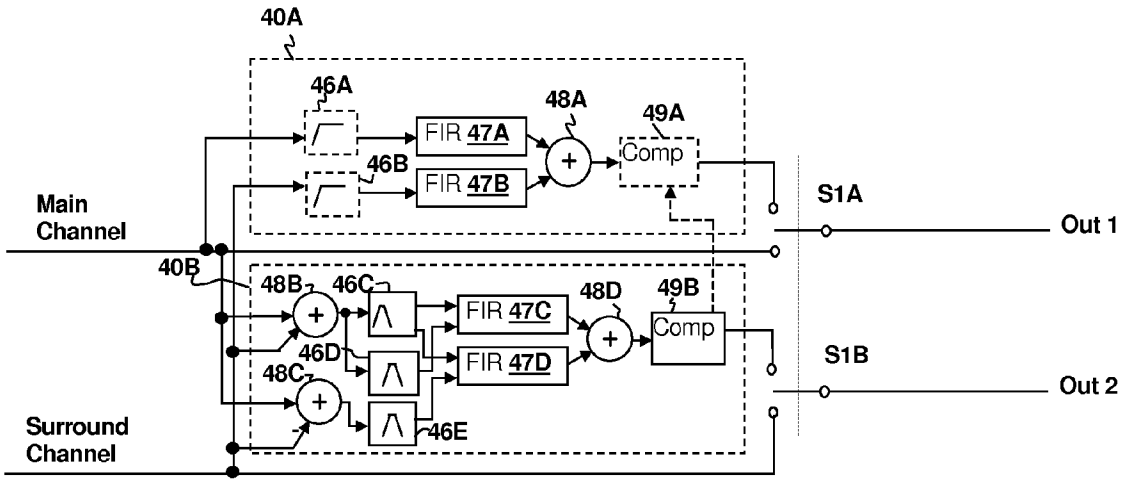
FIG. 4B is a block diagram of a direct and surround channel circuit that is calibrated by a method in accordance with an embodiment of the present invention.

Referring now to FIG. 4B, a direct and surround channel circuit or algorithm, that is calibrated by methods in accordance with embodiments of the present invention, is shown in a block diagram. Only one stereo side (right or left) of the system is shown, as the other side will generally be an identical circuit. A Main Channel and Surround Channel signal are provided to processing blocks 40A and 40B, that provide respective output signals Out 1 and Out 2 to power driver stages that drive a pair of speakers. In a first position, switch portion S1A connects output signal Out 1 to the Main Channel signal and switch portion S1B connects output signal Out 2 to the Surround Channel signal, so that the system can be selectively used with placement of speakers at actual rear room positions. Alternatively, in a second position, switch portion S1A connects output signal Out 1 to the output of processing block 40A and switch portion S1B connects output signal Out 2 to the output of processing block 40B, so that the system provides beam-formed surround for use with placement of speakers at the front of the room as described above.

Processing blocks 40A and 40B are similar processing blocks, but processing block 40A removes low frequency information from output signal Out 1, which serves as a mid-high frequency output in a frequency selective configuration as described above. Similarly, processing block 40B removes high frequency information from output signal Out 2, serving as the mid-low frequency output.

Each of processing blocks 40A and 40B includes two adjustable finite impulse response (FIR) or other suitable digital filters 47A-B and 47C-D, respectively, for calibrating the system maximum surround effect by adjusting the impulse response of each output Out1 and Out2 with respect to each input (Main and Surround Channels). In processing block 40A, an optional pair of high-pass filters 46A and 46B, remove low-frequency information from the Main and Surround Channel signals and a pair of adjustable FIR filters 47A and 47B provide for calibration of the beam-forming system. The outputs of FIR filters 47A and 47B are summed in-phase by a combiner 48A and then applied to an optional compressor 49A that protects a speaker coupled to output signal Out 1 from damage, or in general preserves overhead as the system works to beam-form over the mid frequency range. Also, in other modes such as Night Mode and PIP mode, compression and frequency-selective compression is applied by compressor 49A in order to reduce the audible volume required for intelligibility of speech and to limit the volume of program material such as music.

In processing block 40B, the Main and Surround Channel signals are summed in-phase by a combiner 48B and out-of-phase by a combiner 48C. The output of in-phase combiner 48B is low-pass filtered by filter 46C and provided to inputs of both of a pair of FIR filters 47C and 47D. The output of in-phase combiner 48B is also filtered by a bandpass filter 46D to provide a midrange output and provided to an input of FIR filter 47C. The output of out-of-phase combiner 48C output is also filtered by a bandpass filter 46E to provide a midrange output and provided to an input of FIR filter 47D. The outputs of FIR filters 47C and 47D are then combined and optionally compressed by compressor 49B, which may be linked to compressor 49A to prevent amplifier clipping as the speaker coupled to output signal Out 2 attempts to provide the correct level of midrange signals which may otherwise rise too high as overall system volume is increased. The resulting output of processing block 40B is a signal having the sum of the Main and Surround channel signals in a low-frequency band, and the difference between the Main and Surround channel signals in the midrange beam-forming band. Compressor 49B is also used in other modes such as Night Mode and PIP mode for the same reasons as described above with respect to compressor 49A.

The channel circuit of FIG. 4B is an example of an arrangement of blocks that implement beam-forming that may be calibrated by an embodiment of the present invention, or similar cascaded functions that can be applied in a DSP algorithm and calibrated by another DSP algorithm. However, alternative implementations are possible and in some instances preferred. For example, all of the filtering functions could be performed within FIR filter blocks, with the in-phase/out-of-phase midrange beam-forming summations performed also within the FIR filter blocks. Likewise speaker protection compression can be made part of the filter algorithm, as well. Therefore, a more generic expression of a channel circuit in accordance with an embodiment of the present invention can be made as a set of FIR filters each receiving either a Main or Surround channel signal and having output summed for forming output signals Out 1 and Out 2. Additional FIR filters for each discrete other speaker may be provided (e.g., center speaker or additional horizontally distributed speakers).

Figure 5B:
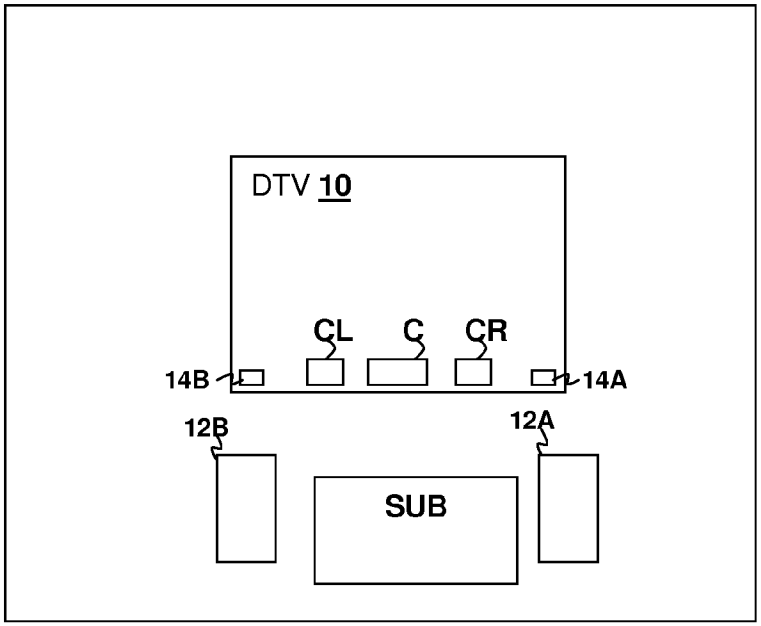
FIG. 5B is an illustration depicting a DTV speaker arrangement that is calibrated by methods in accordance with embodiments of the present invention.
Figure 5A:
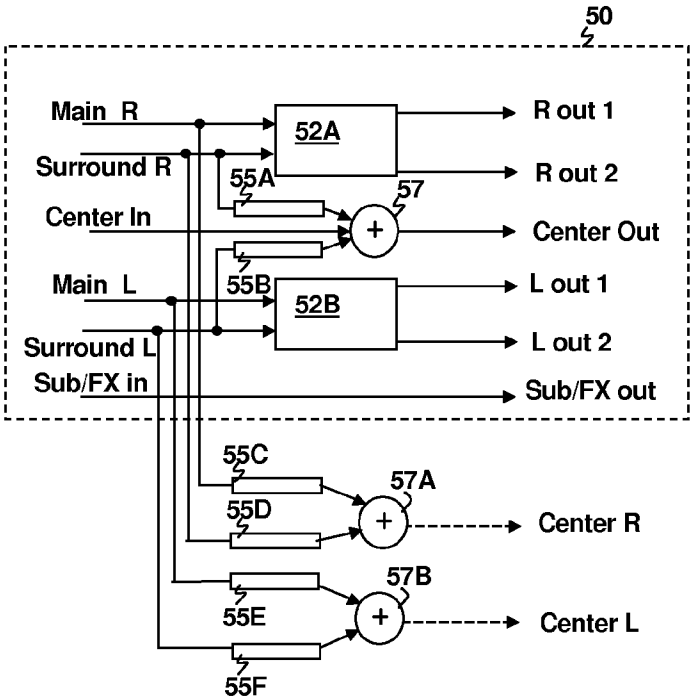
FIG. 5A is a block diagram of yet another system that is calibrated in accordance with embodiments of the present invention.

FIG. 5A is a block diagram of yet another system that is calibrated by embodiments of the present invention, that has an expanded number of speaker output channels. If additional horizontal resolution is provided by horizontally displacing drivers connected to the speaker channels, then enhanced performance can be obtained, particularly in night and PIP modes. Block 50 illustrates a 5.1 surround speaker configuration, adapted for use in a front-only speaker placement.

Channel circuits 52A and 52B provide the right and left channel outputs for the respective pair of beam-forming speakers and can be implemented as described above with respect to FIG. 4B. An additional set of FIR filters 55A-B and a combiner 57 combines time-aligned surround channel signals for left and right channels with the center channel, permitting the center channel to form part of the overall beam-forming array. Optionally, for a 7.1 surround system, additional FIR filters 55C-55F and another pair of combiners 57A-B can be added to generate a Center Right and Center Left output signal for another pair of speakers forming part of the speaker array.

FIG. 5B illustrates an exemplary implementation of a 5.1 or 7.1 DTV system and a consequent speaker arrangement. DTV 10 further includes a center speaker C, along with a center left CL and center right CR speaker. The vertical beam-forming speaker array is provided as described above by internal speakers 14A-B in combination with external speakers 12A-B. A subwoofer/effects channel speaker SUB is located beneath DTV 10. The resultant combination increases the degrees of freedom possible in calibrating maximum surround channel effect via adjustment of the individual FIR filters in channel blocks 52A and 52B as well as additional filters 55A-55F of FIG. 5A. Further, the horizontal arrangement of additional speakers C, CL and CR greatly improves pattern control and isolation in Night Mode and PIP mode.

Figure 6:
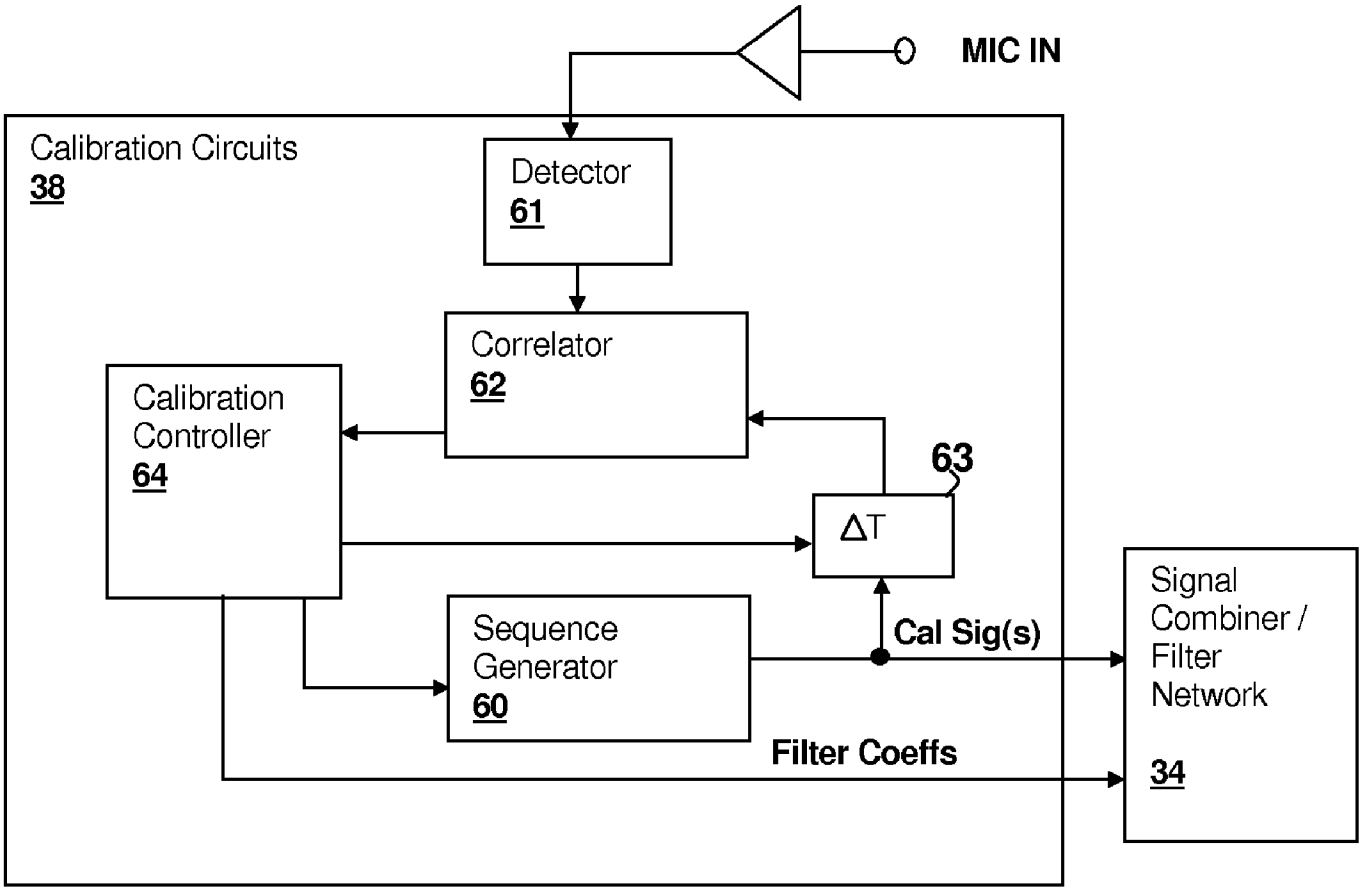
FIG. 6 is a block diagram of a calibration sub-system for performing calibration methods in accordance with an embodiment of the present invention.

Referring now to FIG. 6, a calibration sub-system for performing calibration in accordance with embodiments of the present invention is illustrated in a block diagram. A calibration controller 64 in response to a user control of DTV 10 applies the output of a sequence generator 60 to signal combiner/filter network 34. Either one channel can be calibrated at a time, or multiple uncorrelated sequences can be provided to all channels for simultaneous calibration. An adjustable delay 63 applies the sequence signal(s) to a correlator (or multiple correlators) 62 that correlate the sequence(s) with a microphone signal provided from detector 61. The arrangement permits calibration controller 64 to determine the impulse response of each channel at the microphone position. With the microphone placed at the desired listening position, the system can then be calibrated via the adjustment of the filter coefficients within signal combiner/filter network 34 to minimize the reverberant (reflected) energy with respect to the main channel inputs or otherwise adjust the main channel response for best performance, while maximizing the reverberation with respect to the surround channel inputs. While the illustrated calibration system uses a sequence such as a maximal-length sequence (MLS) to extract the impulse response of the system, frequency sweeping, chirping, or white/pink noise techniques may be similarly employed, with correlator 62 replaced with an appropriate filter.

Figure 7:
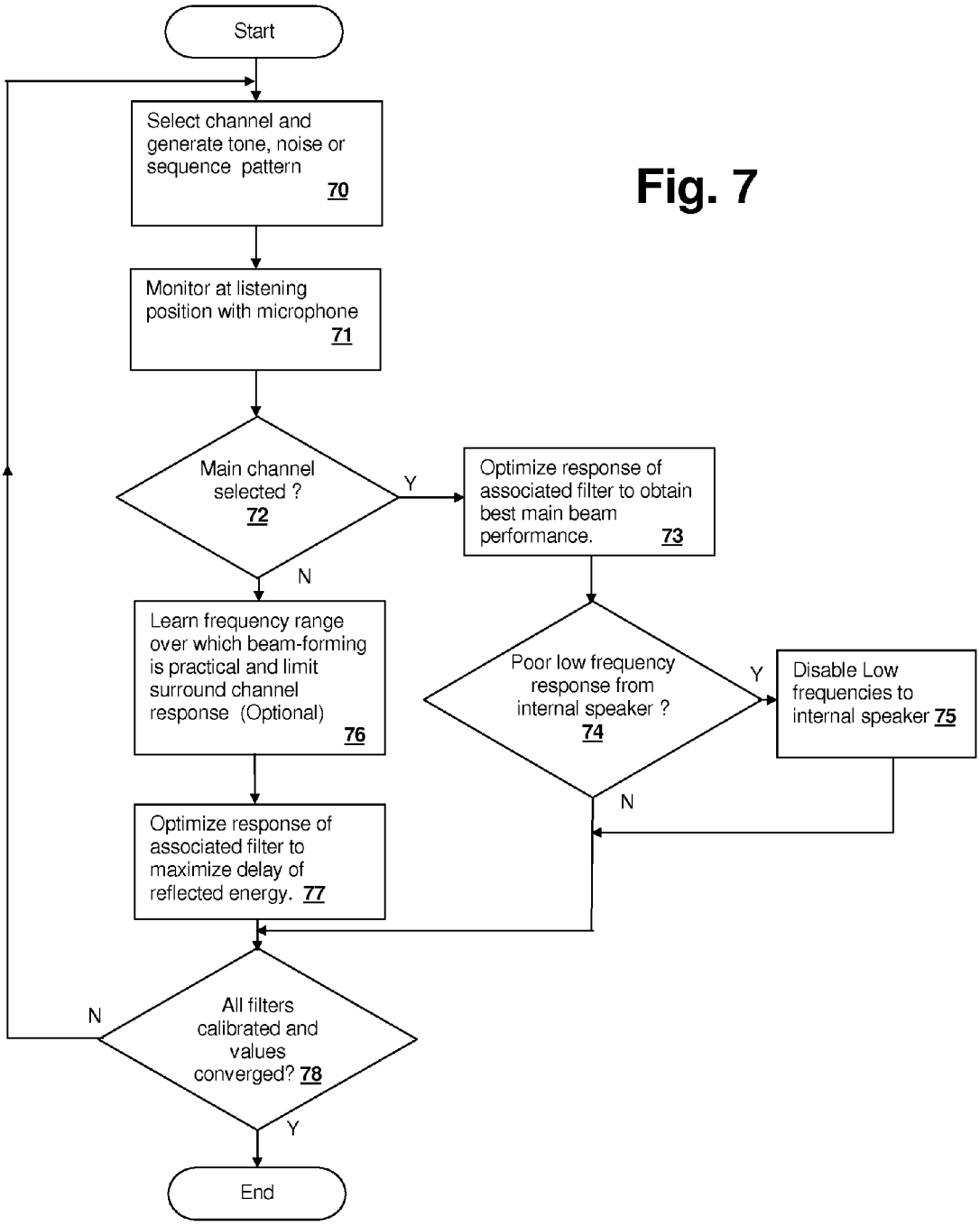
FIG. 7 is a flowchart depicting a surround mode calibration method in accordance with an embodiment of the present invention.

Referring now to FIG. 7, a flowchart depicting a calibration method in accordance with an embodiment of the present invention is shown. The illustrated method is for a single channel calibration on each pass, but the multi-channel simultaneous calibration follows the same pattern. First, an audio input channel is selected and a test signal (tone, noise, or sequence) is generated through the selected channel (step 70). The listening position is monitored with a microphone (step 71), and if the channel under test is a main (direct) channel (decision 72), then the response of the channel filter is optimized to obtain the best main beam performance, and optionally, the level of reflected energy is minimized if performance will not be compromised (step 73). Optionally, if poor low frequency response is detected from the internal speaker (decision 74), then low frequencies can be disabled to that speaker (step 75). The above determination can be made via further selection of not only the channel in step 70, but selectively disabling the signal path to each speaker from the selected channel by disabling the FIR filter that couples the channel to the associated speaker channel.

If the channel under test is a surround channel (decision 72), the frequency range over which beam-forming is practical can optionally be learned and the surround channel response can be limited to that range (step 76). The frequency range over which beam-forming is practical can be determined by determining a low-end frequency at which the direct beam becomes difficult to suppress at the listening position due to loss in phase-cancellation between the internal and external speakers. Similarly, the high-end frequency at which the beam splits into additional beams due to combing can also be detected as a change in the ability to suppress the direct beam at the listening position. After optionally adjusting the surround channel frequency response in optional step 76, the response of the channel filter is optimized to maximize the delay of the reflected energy (step 77) to achieve the maximum reverberant effect. The process from steps 70-77 is repeated over each channel (or performed simultaneously) and also iterated until all filter sets have been calibrated and the values stabilized as between all of the channels (decision 78).

The above-described calibration can be performed by summing the response of one driver in each driver pair with a time-delayed version of the other driver's response. As the delay is varied, a delay is reached having the greatest surround effect, which is determined as the above-described maximum of the ratio of late response to early response. The figure-of-merit is the ratio of late to early energy in the signal received at the microphone. A reasonable cut-off time for considering energy late vs. early for a typical room, is energy arriving more than 5 ms after the initial impulse response (direct energy) for a single speaker is considered late energy. The impulse response of the adjustable FIR filters in each channel can then be adjusted to accomplish the delay, which can be a frequency dependent delay for each driver. The direct response can also be calibrated in a similar manner, with the delay determined to minimize the reflected energy and maximize the direct (non-reflected) energy. In general, it is desirable to achieve the best main beam performance without trying to eliminate reflections, as reflections are ordinarily present for the main beam in a full surround sound installation, as well.

Figure 8A:
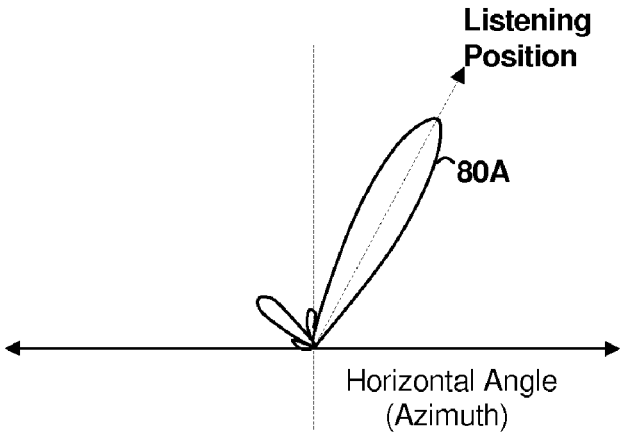
FIGS. 8A and 8B are graphs showing sound pressure level directivity patterns in night mode and picture-in-picture/split screen mode, respectively.
Figure 8B:
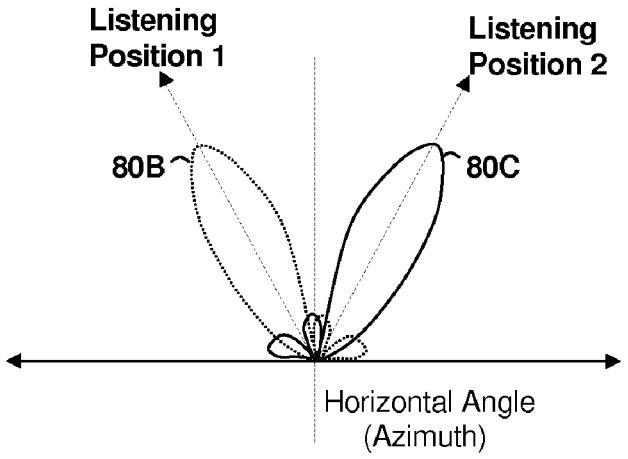

Referring now to FIG. 8A, a directivity graph of the system of the present invention in Night Mode is depicted. A single lobe 80A is formed by adjustment of each of the FIR filters that couple the input channels, which are summed together as a mono signal, to the speakers. FIG. 8B illustrates a directivity graph of the system in PIP or split-screen mode, where two distinct patterns are generated for two different input video program audio information channels. The audio information for each program is summed monophonically and then provided to the right and left main inputs of the above-depicted system. The system is calibrated to produce a lobe 80B or 80C with respect to each program channel. The system is calibrated to best minimize the energy from program 1 (i.e., the desired program in lobe 80B) at listening position 2 and vice-versa.

Figure 9:
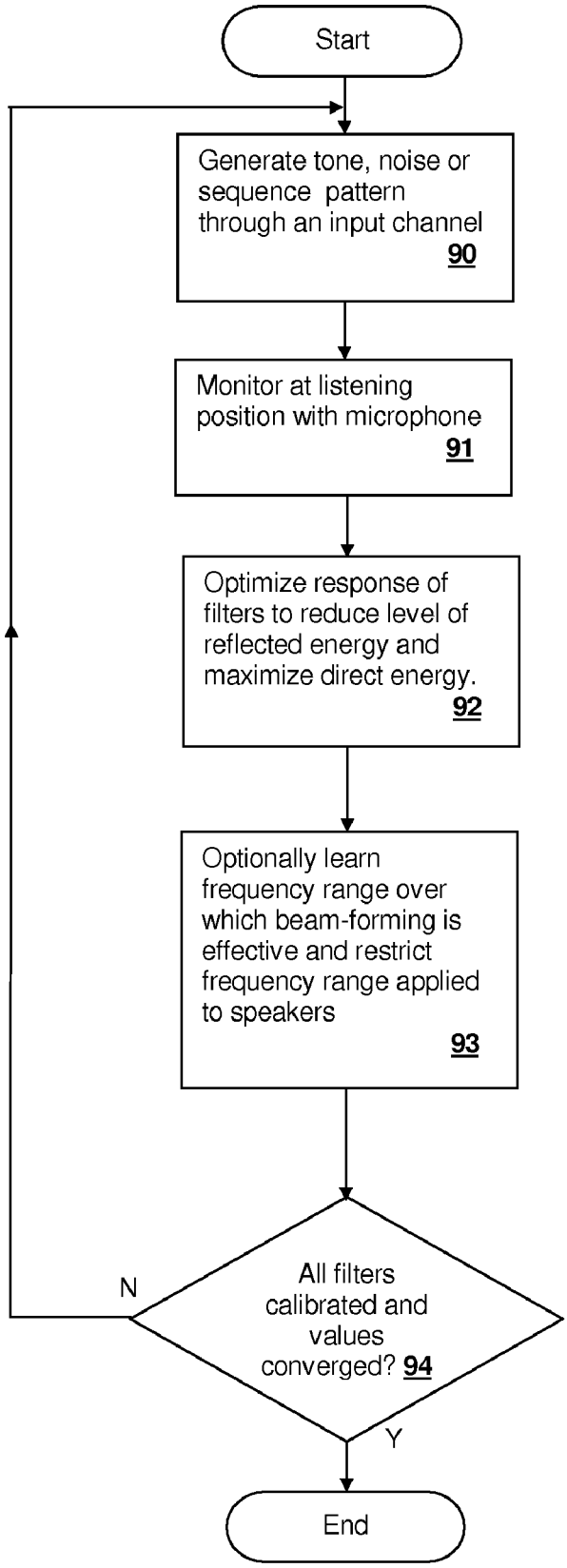
FIG. 9 is a flowchart depicting a night mode calibration method in accordance with an embodiment of the present invention.

Referring now to FIG. 9, a calibration method for Night Mode is depicted in a flowchart, in accordance with an embodiment of the present invention. First, test signal (tone, noise or sequence) is generated through all speaker channels (step 90). The listening position is monitored with a microphone (step 91), and the response of the channel filters is optimized to minimize the level of reverberant energy and to maximize the direct energy (step 92). Optionally, the frequency range over which beam-forming is practical can be learned, and the Night Mode response can be limited to that range (step 93). The frequency range over which beam-forming is practical can be determined by determining a low-end frequency at which the reflected energy becomes difficult to suppress at the listening position. The process from steps 90-93 is repeated over each channel (or performed simultaneously), and also iterated until all filter sets have been calibrated and the values converged as between all of the speaker channels (decision 94).

Figure 10:
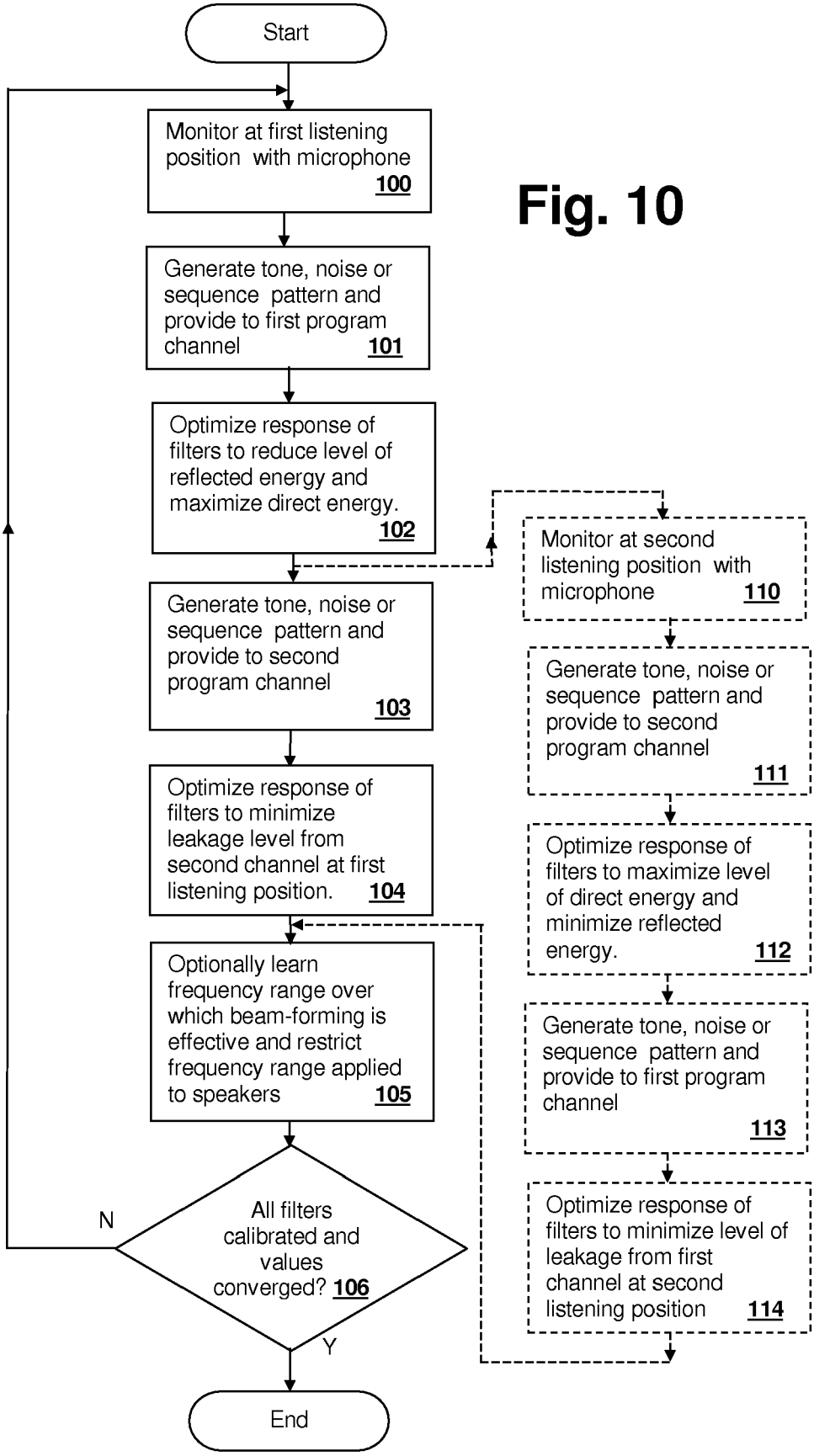
FIG. 10 is a flowchart depicting a picture-in-picture/split screen mode calibration method in accordance with another embodiment of the present invention.

Referring now to FIG. 10, a calibration method for PIP and split-screen Mode is depicted in a flowchart, in accordance with an embodiment of the present invention. The first listening position is monitored with a microphone (step 100). Then, a test signal (tone, noise or sequence) is applied to a first program channel (step 101). The response of the channel filters is optimized to minimize the level of reverberant energy and maximize the direct energy (step 102). Then, all speakers are selected with respect to a second program channel, a tone, noise or sequence is generated through the second program channel (step 103), and the response of the channel filter is optimized to minimize the leakage from the second channel at the first listening position (step 104).

Alternatively, as shown in the dashed blocks, the second listening position may be monitored with a microphone (step 110), a test signal (tone, noise or sequence) is applied to the second program channel (step 111) and the response of the channel filters optimized to minimize the level of reflected energy and maximize the direct energy at the second listening position (step 112). Then, a test signal (tone, noise or sequence) is generated through the first program channel (step 113), and the response of the channel filter is optimized to minimize the leakage from the first channel at the second listening position (step 114). The alternative technique provides improved information regarding the attenuation of first channel sound at the second listening position, but requires a second microphone or repositioning of a single microphone in order to accomplish the calibration.

After either of the alternative sub-methods depicted in steps 103-104 or steps 110-114 has been performed, the frequency range over which beam-forming is practical can be optionally learned and the PIP mode response can be limited to that range (step 105). The frequency range over which beam-forming is practical can be determined by determining a low-end frequency at which the reflected energy becomes difficult to suppress at the program-associated listening position or the direct energy becomes difficult to suppress at the alternate listening position. The process from steps 100-105 is repeated until all filter sets have been calibrated and the values stabilized as between all of the speaker channels (decision 106).

The description provided above constitutes a description of the preferred embodiments of the invention, but the invention is not limited to the particular implementations shown or described. Those skilled in the art, having seen the above description and accompanying drawings, will understand that changes in form, structure and other details, as well as the order of operation of any operative steps may be varied without departing from the spirit and scope of the invention.

What is claimed is:

1. A method for calibrating an audio beam-forming system, comprising:

providing a test signal to a plurality of speaker drivers through an electronic beam-forming network surround channel input;

detecting sound propagated from said plurality of speaker drivers in response to said test signal using a microphone positioned at a listening position; and adjusting at least one corresponding signal relationship between said surround channel input and at least one of said plurality of speaker drivers in conformity with a result of said detecting, to control propagation of surround channel information in a predetermined direction toward said listening position, such that information provided to said surround channel input is propagated with a first directivity pattern having substantial attenuation in said predetermined direction and at least one lobe having a directivity peak located substantially away from said predetermined direction.

2. The method of claim 1, further comprising providing another test signal to at least one of said plurality of speaker drivers through a main channel input to said electronic beam-forming network and adjusting a second corresponding signal relationship between said main channel input and said at least one of said plurality of speaker drivers so that second information provided to said main channel input is propagated with a second directivity pattern having substantially peak amplitude in said predetermined direction.

3. The method of claim 1, wherein at least one of said plurality of speaker drivers has a primary axis directed substantially away from said predetermined direction, and wherein said adjusting said at least one corresponding signal relationship adjusts a gain of a signal path between said surround channel input and said at least one of said plurality of speaker drivers.

4. The method of claim 1, wherein said adjusting said at least one corresponding signal relationship adjusts a frequency-dependent phase response of a signal path between said surround channel input and said at least one of said plurality of speaker drivers.

5. The method of claim 4, further comprising determining an impulse response at said microphone with respect to said surround channel input of said electronic network, and wherein said adjusting maximizes a ratio of energy of a later region of said impulse response to an earlier region of said impulse response, wherein said earlier region of said impulse response extends from a first peak of said impulse response to a predetermined time after said first peak and said later region is a region subsequent to said predetermined time after said first peak.

6. The method of claim 4, further comprising determining an impulse response at said microphone with respect to said surround channel input of said electronic network, and wherein said adjusting adjusts said frequency-dependent phase response to increase energy levels of later portions of said impulse response while reducing energy levels of earlier portions of said impulse response, wherein said earlier portions of said impulse response are after a first peak of said impulse response and before a predetermined time after said first peak, and said later portions are portions subsequent to said predetermined time after said first peak.

7. The method of claim 1, further comprising:

in response to said detecting, determining a frequency range over which said adjusting is effective to provide said substantial attenuation in said first directivity pattern; and limiting a frequency response of said electronic beam-forming network in conformity with said determined frequency range.

8. The method of claim 1, wherein said plurality of speaker drivers includes at least a first and a second speaker driver having differing frequency ranges, and further comprising:

in response to said detecting, determining a frequency range within which said first speaker driver is usable with said second speaker driver to provide said first directivity pattern having substantial attenuation in said predetermined direction; and limiting a frequency response of said electronic beam-forming network in conformity with said determined frequency range.

9. The method of claim 8, wherein said determined frequency range extends beyond a specified operating range for at least one of said first and second speaker drivers.

10. A method for calibrating an audio beam-forming system, comprising:

providing a test signal to a plurality of speaker drivers located in separate cabinets, through an electronic beam-forming network audio input;

detecting sound propagated from said plurality of speaker drivers in response to said test signal using a microphone positioned at a listening position; and adjusting at least one corresponding signal relationship between said input and each of said plurality of speaker drivers in conformity with a result of said detecting, to control propagation of sound in a predetermined direction toward said listening position, such that sound propagating in directions other than said predetermined direction is minimized.

11. The method of claim 10, further comprising determining an impulse response at said microphone with respect to said audio input of said electronic network, and wherein said adjusting minimizes a ratio of energy of a later region of said impulse response to an earlier region of said impulse response, wherein said earlier region of said impulse response extends from a first peak of said impulse response to a predetermined time after said first peak and said later region is a region subsequent to said predetermined time after said first peak.

12. The method of claim 10, further comprising:

in response to said detecting, determining a frequency range over which said adjusting is effective to attenuate sound in directions other than said predetermined direction; and limiting a frequency response of said electronic beam-forming network in conformity with said determined frequency range.

13. The method of claim 10, wherein said plurality of speaker drivers includes at least a first and a second speaker driver having differing frequency ranges, and further comprising:

in response to said detecting, determining a frequency range within which said first speaker driver is usable with said second speaker driver to attenuate sound in directions other than said predetermined direction; and limiting a frequency response of said electronic beam-forming network in conformity with said determined frequency range.

14. The method of claim 13, wherein said determined frequency range extends beyond a specified operating range for at least one of said first and second speaker drivers.

15. A method for calibrating an audio beam-forming system to maximize separation between first audio program information provided for a first listening position and second audio program information provided for a second listening position, comprising:

providing a test signal to a plurality of speaker drivers located in separate cabinets, through an electronic beam-forming network first audio input for receiving said first audio program information;

detecting sound propagated from said plurality of speaker drivers in response to said test signal using a microphone positioned in at least one of said first and second listening positions; and adjusting at least one corresponding signal relationship between said first audio input and each of said plurality of speaker drivers in conformity with a result of said detecting, to control propagation of sound in a first predetermined direction toward said first listening position, such that sound propagating toward a second listening position resulting from said test signal supplied to said first audio input is minimized.

16. The method of claim 15, wherein said detecting is performed with said microphone positioned first at said first listening position with said test signal provided to said first audio input, and second at said second listening position with said test signal provided to a second audio input for receiving said second audio program information, and wherein said adjusting is repeated for both positions of said microphone, and wherein said adjusting further to control propagation of sound in a second predetermined direction toward said second listening position, such that sound propagating toward a first listening position resulting from said test signal supplied to said second audio input is minimized.

17. The method of claim 15, further comprising determining an impulse response at said microphone with respect to said first audio input of said electronic network, and wherein said adjusting minimizes a ratio of energy of a later region of said impulse response to an earlier region of said impulse response, wherein said earlier region of said impulse response extends from a first peak of said impulse response to a predetermined time after said first peak and said later region is a region subsequent to said predetermined time after said first peak.

18. The method of claim 15, further comprising:

in response to said detecting, determining a frequency range over which said adjusting is effective to attenuate sound resulting from said second program information at said first listening position; and limiting a frequency response of said electronic beam-forming network in conformity with said determined frequency range.

19. The method of claim 15, wherein said plurality of speaker drivers includes at least a first speaker driver and a second speaker driver having differing frequency ranges, and further comprising:

in response to said detecting, determining a frequency range within which said first speaker driver is usable with said second speaker driver to attenuate sound resulting from said second program information at said first listening position; and limiting a frequency response of said electronic beam-forming network in conformity with said determined frequency range.

20. The method of claim 19, wherein said determined frequency range extends beyond a specified operating range for at least one of said first and second speaker drivers.

* * * * *